US009364712B2

(12) United States Patent
Wu

(10) Patent No.: US 9,364,712 B2
(45) Date of Patent: Jun. 14, 2016

(54) TORQUE DETECTING ASSEMBLY

(71) Applicant: Mu-Chuan Wu, Tainan (TW)

(72) Inventor: Mu-Chuan Wu, Tainan (TW)

( * ) Notice: Subject to any disclaimer, the term of this patent is extended or adjusted under 35 U.S.C. 154(b) by 0 days.

(21) Appl. No.: 14/507,557

(22) Filed: Oct. 6, 2014

(65) Prior Publication Data

US 2016/0096070 A1 Apr. 7, 2016

(51) Int. Cl.

*A63B 24/00* (2006.01)
*A63B 23/04* (2006.01)
*A63B 21/00* (2006.01)

(52) U.S. Cl.

CPC ..... *A63B 24/0062* (2013.01); *A63B 21/00069* (2013.01); *A63B 21/00192* (2013.01); *A63B 21/4034* (2015.10); *A63B 21/4049* (2015.10); *A63B 23/0476* (2013.01)

(58) Field of Classification Search

CPC ..... A63B 24/00; A63B 24/0062; A63B 23/0476; A63B 21/00069; A63B 21/00192; A63B 21/4034; A63B 21/4049

IPC ..... A63B 24/00, 24/008, 24/07, 24/0062, A63B 21/154, 21/225

See application file for complete search history.

(56) References Cited

U.S. PATENT DOCUMENTS

| | | | | |
|---|---|---|---|---|
| 4,798,379 | A * | 1/1989 | Jenkins | A63B 21/154 482/115 |
| 2013/0210583 | A1* | 8/2013 | Kametani | A63B 24/0062 482/8 |
| 2014/0171272 | A1* | 6/2014 | Hawkins, III | A63B 24/0087 482/61 |
| 2014/0274600 | A1* | 9/2014 | Dalebout | A63B 21/225 482/115 |

* cited by examiner

*Primary Examiner* — Glenn Richman

(74) *Attorney, Agent, or Firm* — Alleman Hall McCoy Russell & Tuttle LLP

(57) ABSTRACT

A torque detecting assembly connected to a torque acting assembly and a controller, the torque detecting assembly has a passive rotating member and a rotating angle detecting member. The passive rotating member is mounted on a pivot shaft of a torque bracket of the torque acting assembly and is capable of rotating synchronously with the pivot shaft and the torque bracket in an angular extent. The rotating angle detecting member is mounted on the torque acting assembly and is capable of detecting a signal according to rotating angle variation of the passive rotating member to calculate out a torque value. The torque detecting assembly may detect slight rotation of the passive rotating member and calculate out a corresponding torque value.

5 Claims, 4 Drawing Sheets

TORQUE DETECTING ASSEMBLY

BACKGROUND OF THE INVENTION

1. Field of the Invention

The present invention relates to a torque detecting assembly, and more particularly to a torque detecting assembly applied to indoor exercise devices such as exercise bikes and being capable of detecting torque of the indoor exercise devices.

2. Description of Related Art

A conventional exercise bike has torque adjusting functions such that a user is able to change the torque of the exercise bike based on personal physical condition or training demands. Therefore, the conventional exercise bike has a torque adjusting assembly and a torque detecting assembly that is combined to a controller. The user may change a torsion resistance to a wheel of the exercise bike by the torque adjusting assembly. A changed torque value may be detected by the torque detecting assembly and is shown on a monitor screen of the exercise bike.

A conventional torque adjusting assembly has an adjusting knob assembly and a mounting bracket. The adjusting knob assembly is rotatably mounted on the exercise bike. The mounting bracket is connected pivotally to the adjusting knob assembly and is mounted pivotally on a frame of the exercise bike. A conventional torque detecting assembly has a variable resistor and an electrical contact. The variable resistor is mounted eccentrically on the exercise bike. The electrical contact is mounted securely on the mounting bracket and movably contacts the variable resistor. By rotating the adjusting knob assembly, the mounting bracket is pivoted and a contacting point of an electrical contact on the variable resistor is varied along a curved path to change a resistance value such that a changed torque value is calculated and shown on the exercise bike.

Alternatively, the conventional torque detecting assembly has a combination of a Hall effect sensor integrated circuit and an induction magnet. The Hall Effect sensor integrated circuit (IC) is mounted securely on the frame the exercise bike. The induction magnet is mounted eccentrically on the mounting bracket and is movable relative to the Hall Effect sensor IC along a curved path. By rotating an adjusting knob of the torque adjusting assembly, the mounting bracket is pivoted, the induction magnet is moved and the Hall Effect sensor IC detects signal variation such that a changed torque value is calculated and shown on the exercise bike. Therefore, the torque detecting assembly is not able to precisely detect slight torque variation.

However, the aforementioned torque detecting assembly detects the torque value according to a displacement of the electrical contact or induction magnet on the curved path. The displacement of the electrical contact or induction magnet is inadvertently changed due to deformation or tolerance of components of the exercise bike.

To overcome the shortcomings, the present invention provides a torque detecting assembly to mitigate or obviate the aforementioned problems.

SUMMARY OF THE INVENTION

The main objective of the invention is to provide a torque detecting assembly applied to indoor exercise devices such as exercise bikes and being capable of detecting torque of the indoor exercise devices.

A torque detecting assembly in accordance with the present invention connected to a torque acting assembly and a controller, the torque detecting assembly has a passive rotating member and a rotating angle detecting member. The passive rotating member is mounted on a pivot shaft of a torque bracket of the torque acting assembly and is capable of rotating synchronously with the pivot shaft and the torque bracket in an angular extent. The rotating angle detecting member is mounted on the torque acting assembly and is capable of detecting a signal according to rotating angle variation of the passive rotating member to calculate out a torque value. The torque detecting assembly may detect slight rotation of the passive rotating member and calculate out a corresponding torque value.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
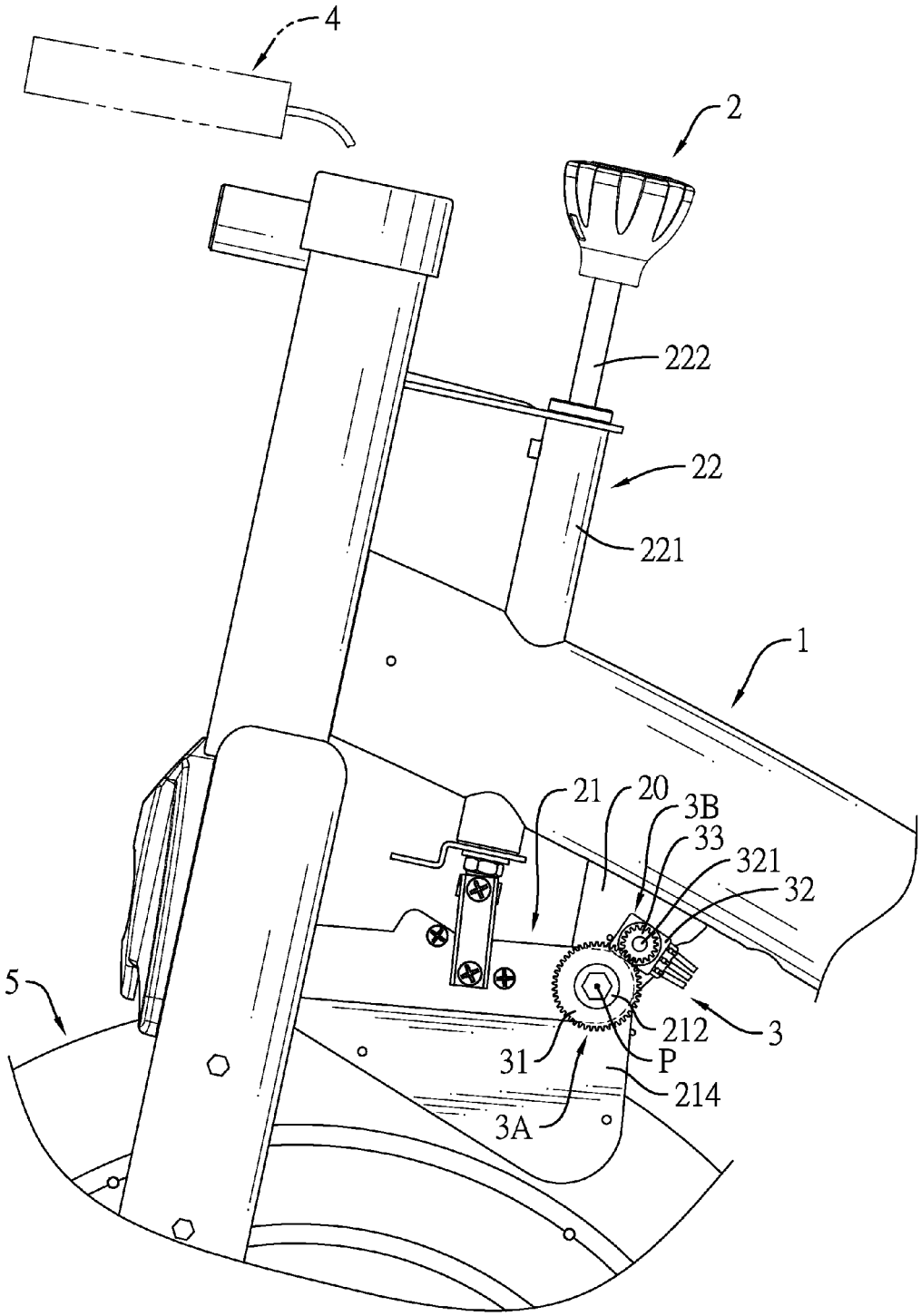
FIG. 1 is a side view of a first embodiment of a torque detecting assembly in accordance with the present invention, a torque adjusting assembly and a frame of an exercise bike.
Figure 2:
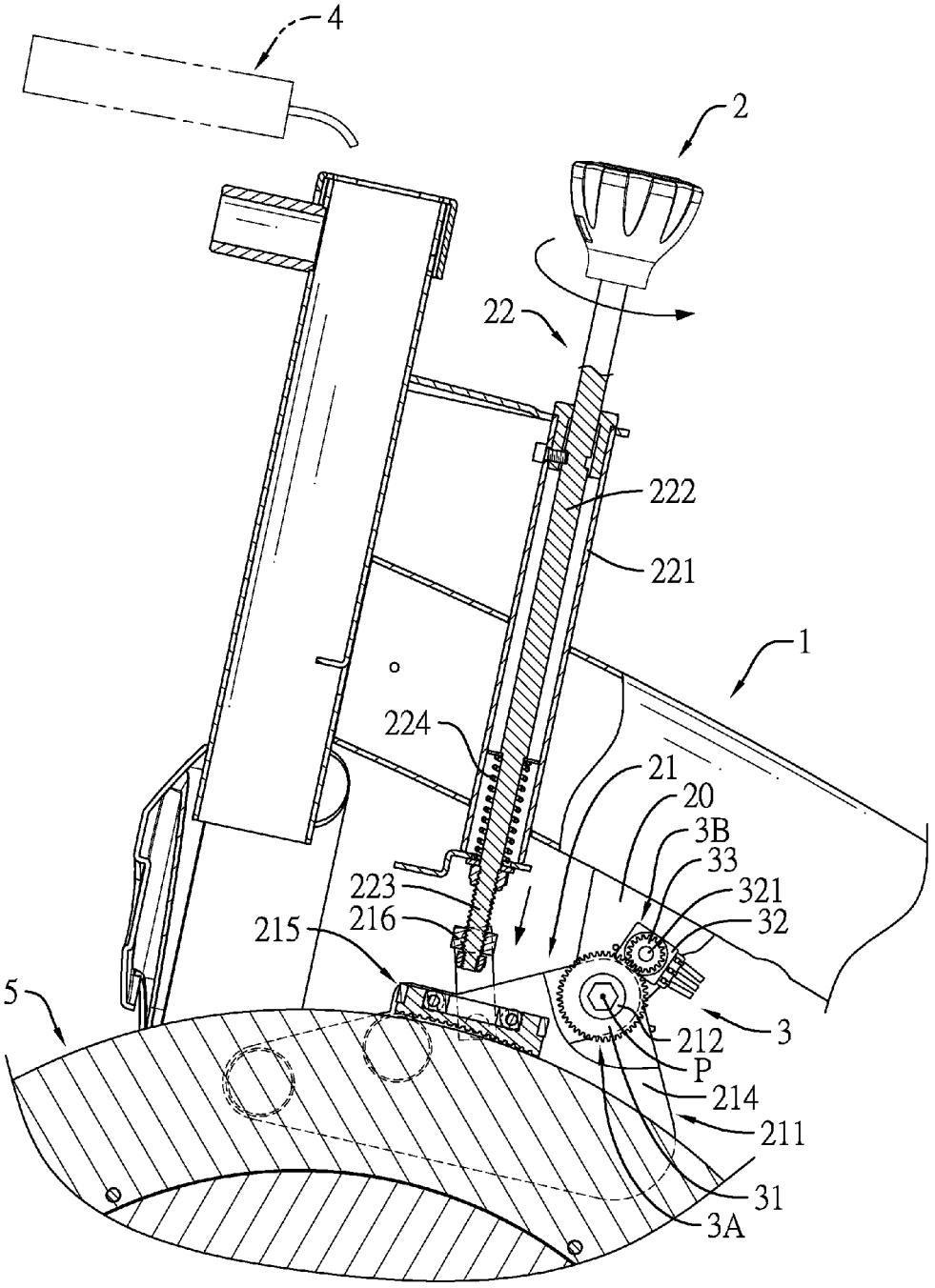
FIG. 2 is a side view in partial section of the torque detecting assembly in FIG. 1, the torque adjusting assembly and the frame of an exercise bike.

With reference to FIGS. 1 and 2, a torque detecting assembly 3 in accordance with the present invention and a torque adjusting device 2 are mounted on a frame 1 of an exercise bike. The exercise bike has a controller 4 and a wheel 5. The controller 4 is mounted securely on the exercise bike and has a screen. The wheel 5 is mounted rotatably on the exercise bike. The exercise bike is conventional such that detailed descriptions of remaining structures of the exercise bike are omitted.

The torque detecting assembly 3 is mounted between the frame 1 and the torque adjusting device 2, is connected to the controller 4 and is capable of detecting the torque applied by the torque adjusting device to the wheel 5. The screen of the controller 4 is able to show a torque value such that a user may adjust the torque according to the torque value on the screen.

Figure 4:
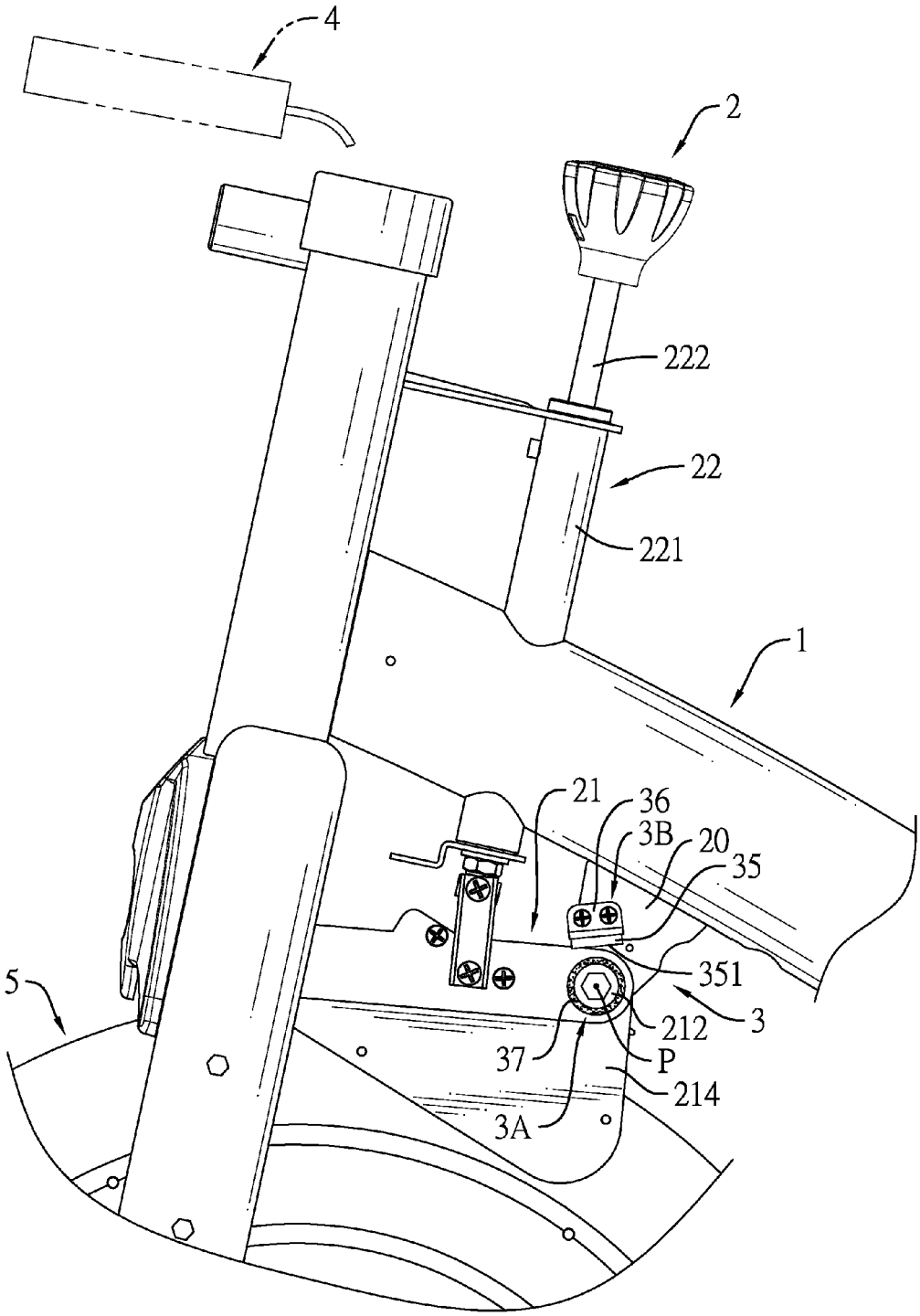
FIG. 4 is a perspective view of a third embodiment of a torque detecting assembly in accordance with the present invention, a torque adjusting assembly and a frame of an exercise bike.

With reference to FIGS. 1, 2 and 4, the torque adjusting device 2 has a base 20, a torque acting assembly 21 and a torque adjusting assembly 22.

The base 20 is mounted securely on the frame 1 of the exercise bike near the wheel 5.

The torque acting assembly 21 has a torque bracket 211, a pivot shaft 212 and a torsion spring 213. The torque bracket 211 has a bracket member 214, an obstructing member 215 and a connecting member 216. The bracket member 214 is mounted around the wheel 5. The obstructing member 215 is mounted in the bracket member 214 and is capable of contacting a periphery of the wheel 5. The connecting member 216 is mounted rotatably on the bracket member 214 and has a threaded hole defined in the connecting member 216 and located outside the wheel 5. The pivot shaft 212 is mounted securely through the bracket member 214 of the torque bracket 211, is mounted rotatably on the base 20 and serves as a fulcrum P such that the torque bracket 211 is able to pivot based on the fulcrum P within a specific angular extent. The torsion spring 213 is mounted around the pivot shaft 212 and has two ends. One end of the torsion spring 213 presses against the base 20, and the other end presses against the bracket member 214 of the torque bracket 211.

With reference to FIGS. 1 and 2, the torque adjusting assembly 22 has a stationary tube 221, an adjusting shaft 222 and a compression spring 224.

The stationary tube 221 is mounted securely on the frame 1 and is located near the wheel 5 and the torque acting assembly 21. The adjusting shaft 222 is mounted rotatably and slidably through the stationary tube 221, extends upward out of the stationary tube 221 and has a rotating knob and a threaded portion 223. The rotating knob is mounted on a top end of the adjusting shaft 222. The threaded portion 223 is formed on a bottom end of the adjusting shaft 222 and is connected rotatably to the threaded hole of the connecting member 216. The compression spring 224 is mounted in the stationary tube 221 around the adjusting shaft 222 and has two ends. One end of the compression spring 224 is mounted securely on the adjusting shaft 222 and the other end presses against an inner surface of a bottom end of the stationary tube 221. Manually rotating the adjusting knob of the adjusting shaft 222 drives the connecting member 216 to move along the adjusting shaft 222 such that the torque bracket 211 is pivoted relative to the pivot shaft 212 serving as the fulcrum P and the torque of the obstructing member 215 applied to the wheel 5 is adjusted.

With reference to FIGS. 1 and 2, the torque detecting assembly 3 has a passive rotating member 3A and a rotating angle detecting member 3B.

The passive rotating member 3A is mounted on the pivot shaft 212 of the torque acting assembly 21 and is capable of rotating synchronously with the pivot shaft 212 in a limited angular extent.

The rotating angle detecting member 3B is mounted on the torque bracket 211 of the torque acting assembly 21 and is capable of detecting a signal according to rotating angle variation of the passive rotating member 3A to calculate out a torque value.

With reference to FIGS. 1 and 2, in a first embodiment of the torque detecting assembly 3, the passive rotating member 3A has a transmission gear 31. The transmission gear 31 is mounted securely on the pivot shaft 212 of the torque acting assembly 21 and is capable of rotating synchronously with the pivot shaft 212. The rotating angle detecting member 3B has a variable resistor 32 and a driven gear 33. The variable resistor 32 is mounted securely on the torque bracket 211 of the torque acting assembly 21, is connected electrically to the controller 4 and has a pivot pin 321. The pivot pin 321 is mounted rotatably on the variable resistor 32 and rotation of the pivot pin 321 varies a resistance value of the variable resistor 32. The driven gear 33 is mounted securely around the pivot pin 321 and is engaged with the transmission gear 31. A diameter of the driven gear 33 is smaller than that of the transmission gear 31. Preferably, a gear ratio of the transmission gear 31 and the driven gear 33 is 2:1.

With reference to FIGS. 1 and 2, when the torque adjusting assembly 22 drives the torque bracket 211 of the torque acting assembly 21 to rotate relative to the pivot shaft 212 to adjust the force of the obstructing member 215 on the wheel 5, the driven wheel 31 is rotated with the torque bracket 211. The driven gear 33 engaged with the transmission gear 31 is therefore rotated. The resistance value of the variable resistor 32 is changed. Thus, the controller 4 electrically connected to the variable resistor 32 calculates out the current torque value according to the signal of the resistance variation of the variable resistor 32 by reference to a torque value list.

Figure 3:
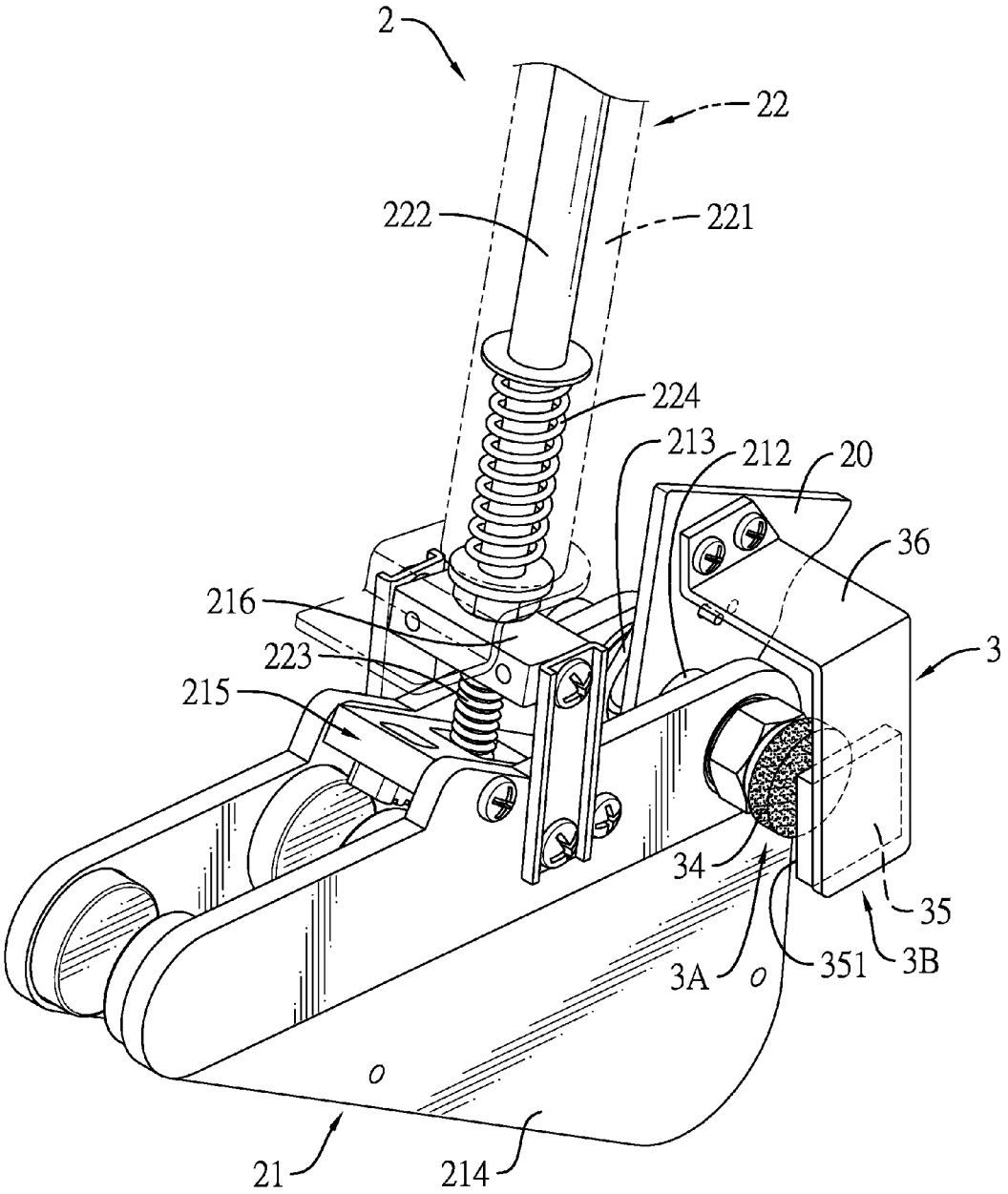
FIG. 3 is a side view of a second embodiment of a torque detecting assembly in accordance with the present invention, a torque adjusting assembly and a frame of an exercise bike.

With reference to FIG. 3, in a second embodiment of the torque detecting assembly 3, the passive rotating member 3A has a circular permanent magnet 34. The circular permanent magnet 34 is mounted securely on the pivot shaft 212 of the torque acting assembly 21 and is capable of rotating synchronously with the pivot shaft 212. The rotating angle detecting member 3B has a rotation sensing IC 35. The rotation sensing IC 35 is mounted on the torque bracket 211 through a mounting bracket 36, is connected electrically to the controller 4 and has a sensing element 351. The sensing element 351 is located axially near an end of the circular permanent magnet 34 without contacting the circular permanent magnet 34 and is capable of sensing signal from magnet field variation according to rotating angle variation of the circular permanent magnet 34.

With reference to FIG. 3, when the torque adjusting assembly 22 drives the torque bracket 211 of the torque acting assembly 21 to rotate relative to the pivot shaft 212 to adjust the force of the obstructing member 215 on the wheel 5, the circular permanent magnet 34 is rotated with the torque bracket 211. The rotation sensing IC 35 senses signal from magnet field variation according to rotating angle variation of the circular permanent magnet 34. The controller 4 electrically connected to the rotation sensing IC 35 calculates out the torque value according to the signal of magnet field variation by reference to a torque value list.

With reference to FIG. 4, in a second embodiment of the torque detecting assembly 3, the passive rotating member 3A has an annular permanent magnet 34. The annular permanent magnet 37 is mounted securely on the pivot shaft 212 of the torque acting assembly 21 and is capable of rotating synchronously with the pivot shaft 212. The rotating angle detecting member 3B has a rotation sensing IC 35. The rotation sensing IC 35 is mounted on the torque bracket 211 through a mounting bracket 36, is connected electrically to the controller 4 and has a sensing element 351. The sensing element 351 is located radially near the annular permanent magnet 37 without contacting the annular permanent magnet 37 and is capable of sensing signal from magnet field variation according to rotating angle variation of the annular permanent magnet 37.

With reference to FIG. 4, when the torque adjusting assembly 22 drives the torque bracket 211 of the torque acting assembly 21 to rotate relative to the pivot shaft 212 to adjust the force of the obstructing member 215 on the wheel 5, the annular permanent magnet 37 is rotated with the torque bracket 211. The rotation sensing IC 35 senses signal from magnet field variation according to rotating angle variation of the annular permanent magnet 37. The controller 4 electrically connected to the rotation sensing IC 35 calculates out the torque value according to the signal of magnet field variation by reference to a torque value list.

The torque detecting assembly 3 of the present invention sets the passive rotating member 3A on the pivot shaft 212 of the torque acting assembly 21. The passive rotating member 3A is rotated synchronously with the pivot shaft 212 when the torque adjusting device 2 is operated. The rotating angle detecting member 3B is able to detect signal due to rotation of the passive rotating member 3A. Even slight rotation of the passive rotating member 3A can be detected by the torque detecting assembly 3 and a corresponding torque value can be calculated out.

Even though numerous characteristics and advantages of the present invention have been set forth in the foregoing description, together with details of the structure and function of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A torque detecting assembly connected to a torque acting assembly and a controller, the torque detecting assembly comprising:

a passive rotating member mounted on a pivot shaft of a torque bracket of the torque acting assembly and being capable of rotating synchronously with the pivot shaft and the torque bracket in an angular extent; and a rotating angle detecting member mounted on the torque acting assembly and being capable of detecting a signal according to rotating angle variation of the passive rotating member to calculate out a torque value;

wherein the passive rotating member has a transmission gear mounted securely on the pivot shaft of the torque acting assembly; and wherein the rotating angle detecting member has a variable resistor mounted securely on the torque acting assembly, connected electrically to the controller and having a pivot pin mounted rotatably on the variable resistor, wherein rotation of the pivot pin varies a resistance value of the variable resistor; and a driven gear mounted securely around the pivot pin and engaged with the transmission gear.

2. The torque detecting assembly as claimed in claim 1, wherein a diameter of the driven gear is smaller than that of the transmission gear.

3. The torque detecting assembly as claimed in claim 1, wherein a gear ratio of the transmission gear and the driven gear is 2:1.

4. A torque detecting assembly connected to a torque acting assembly and a controller, the torque detecting assembly comprising:

a passive rotating member mounted on a pivot shaft of a torque bracket of the torque acting assembly and being capable of rotating synchronously with the pivot shaft and the torque bracket in an angular extent; and a rotating angle detecting member mounted on the torque acting assembly and being capable of detecting a signal according to rotating angle variation of the passive rotating member to calculate out a torque value;

wherein the passive rotating member has a circular permanent magnet mounted securely on the pivot shaft of the torque acting assembly and being capable of rotating synchronously with the pivot shaft; and wherein the rotating angle detecting member has a rotation sensing IC mounted on the torque bracket through a mounting bracket, connected electrically to the controller and having a sensing element located axially near an end of the circular permanent magnet without contacting the circular permanent magnet and being capable of sensing a signal from magnet field variation according to rotating angle variation of the circular permanent magnet.

5. A torque detecting assembly connected to a torque acting assembly and a controller, the torque detecting assembly comprising:

a passive rotating member mounted on a pivot shaft of a torque bracket of the torque acting assembly and being capable of rotating synchronously with the pivot shaft and the torque bracket in an angular extent; and a rotating angle detecting member mounted on the torque acting assembly and being capable of detecting a signal according to rotating angle variation of the passive rotating member to calculate out a torque value;

wherein the passive rotating member has an annular permanent magnet mounted securely on the pivot shaft of the torque acting assembly and being capable of rotating synchronously with the pivot shaft; and wherein the rotating angle detecting member has a rotation sensing IC mounted on the torque bracket through a mounting bracket, connected electrically to the controller and having a sensing element located radially near the annular permanent magnet without contacting the annular permanent magnet and being capable of sensing a signal from magnet field variation according to rotating angle variation of the annular permanent magnet.

* * * * *